US009987604B2

(12) United States Patent
Baaske et al.

(10) Patent No.: US 9,987,604 B2
(45) Date of Patent: Jun. 5, 2018

(54) METHOD AND APPARATUS FOR CONTACTLESS MIXING OF LIQUIDS

(71) Applicant: NanoTemper Technologies GmbH, München (DE)

(72) Inventors: Philipp Baaske, München (DE); Stefan Duhr, München (DE)

(73) Assignee: NANOTEMPER TECHNOLOGIES GMBH, Munich (DE)

( * ) Notice: Subject to any disclaimer, the term of this patent is extended or adjusted under 35 U.S.C. 154(b) by 0 days. days.

(21) Appl. No.: 14/227,521

(22) Filed: Mar. 27, 2014

(65) Prior Publication Data

US 2014/0293731 A1 Oct. 2, 2014

(30) Foreign Application Priority Data

Mar. 27, 2013 (EP) ..... 13161448

(51) Int. Cl.
*B01F 13/00* (2006.01)
*B01F 15/00* (2006.01)

(52) U.S. Cl.
CPC ..... *B01F 13/0006* (2013.01); *B01F 13/001* (2013.01); *B01F 13/0011* (2013.01); *B01F 13/0081* (2013.01); *B01F 15/00123* (2013.01); *B01F 2215/0431* (2013.01); *B01F 2215/0472* (2013.01)

(58) Field of Classification Search
CPC ..... B01F 13/0059; B01F 13/0006; B01F 13/001; B01F 13/0011; B01F 13/0081; B01F 15/00123; H05B 6/00; A23L 5/34
USPC ..... 366/140, 144, DIG. 4; 250/216
See application file for complete search history.

(56) References Cited

U.S. PATENT DOCUMENTS 5,150,705 A * 9/1992 Stinson ..... A61L 2/0011 250/437
5,823,676 A * 10/1998 Khijniak ..... B01F 13/0001 366/144
7,869,013 B2 * 1/2011 Wang ..... G01N 21/553 356/73
7,968,117 B1 6/2011 Morrison et al.
(Continued)

FOREIGN PATENT DOCUMENTS

DE 103 25 307 B3 7/2004
DE 10 2007 038 797 A1 2/2009
(Continued)

OTHER PUBLICATIONS

Goldstein et al., The influence of transport on the kinetics of binding to surface receptors: application to cells and BIAcore, Journal of Molecular Recognition, 1999, vol. 12, pp. 293-299.
(Continued)

*Primary Examiner* — Anshu Bhatia
(74) *Attorney, Agent, or Firm* — Foley & Lardner LLP

(57) ABSTRACT

The invention generally relates to an apparatus and a method for mixing of liquids (50) or of particles with a liquid (50). In a volume of liquid (50), a thermal convection flow is generated at at least one surface of the volume of liquid by irradiating IR radiation (30) into the volume of liquid. Thereby it is possible to avoid a depletion zone at the surface and to more accurately measure interactions of the particles with the surface by means of surface-based measurement methods.

24 Claims, 7 Drawing Sheets

(56) References Cited

U.S. PATENT DOCUMENTS

| | | | | |
|---|---|---|---|---|
| 2010/0044586 | A1* | 2/2010 | Duhr | B01L 3/502761<br>250/459.1 |
| 2010/0321696 | A1* | 12/2010 | Malik | B01L 3/502715<br>356/432 |
| 2011/0084218 | A1* | 4/2011 | Duhr | B01L 3/508<br>250/459.1 |

FOREIGN PATENT DOCUMENTS

| | | | |
|---|---|---|---|
| WO | WO-2006/042746 | A1 | 4/2006 |
| WO | WO-2012/103897 | A1 | 8/2012 |
| WO | WO 2012/167221 | A1 | 12/2012 |

OTHER PUBLICATIONS

Duhr, S., et al.; "Thermophoresis of DNA determined by microfluidic fluorescence"; The European Physical Journal E 15, 277-286 (2004); Nov. 1, 2004.

Vela, E., et al.; "Non-contact Mesoscale Manipulation Using Laser Induced Convection Flows"; 2018 IEEE/RSJ International Conference on Intelligent Robots and Systems, Nice, France, Sep. 2226, 2008; pp. 913-918.

European Search Report issued in application 14162100.3 dated Aug. 1, 2014; 8 pages.

* cited by examiner (A) Multi-well plate irradiation through floor (B) Multi-well plate irradiation directly into liquid Multi-well plate irradiation and detection through floor

METHOD AND APPARATUS FOR CONTACTLESS MIXING OF LIQUIDS

The invention generally relates to a method and an apparatus for contactless mixing of liquids and/or for mixing of particles in a liquid, and, in particular, for mixing of aqueous solutions. According to the invention, a directed fluid motion is produced, through specific irradiation of electromagnetic radiation into a liquid, in order to transport, for example, particles, preferably particles dissolved in said liquid, to a surface and/or a boundary surface of a sample chamber and/or a surface of a volume of liquid, to ensure mixing of the particles with the liquid, in particular at the surface/boundary. The invention is advantageous in that it avoids a "depletion layer" with a reduced particle concentration, or a "concentration layer" with an increased particle concentration, at the surface/boundary surface, so that it is possible to improve surface-based and/or boundary-based measurement methods.

The invention provides the further advantage of making it possible to mix small volumes (micro volumes) which are difficult to mix, for example, by mechanical impacts, such as shaking or vibration.

Furthermore, the invention specifically relates to a method and/or an apparatus for analyzing specific and unspecific interactions of particles, which are preferably dissolved in a liquid, with surfaces and/or boundary surfaces.

BACKGROUND OF THE INVENTION

The measurement of physical, chemical, biochemical and/or biological processes, such as reactions, binding and annealing processes and other interactions of particles with surfaces are of particular interest in the fields of quality control, drug discovery, medicine, basic research and molecular diagnostics. For analyzing these processes, methods, such as reflectrometric interference spectroscopy (RIfs), bio-layer interferometry (BLI), surface plasmone resonance (SPR), quartz crystal microbalance (QCM), surface acoustic wave (SAW), enzyme linked immunosorbent assay (ELISA), or even nanopores or transistors (next generation sequencing), are used.

Further exemplary methods include fluorescence measurements, fluorescence anisotropy measurements, Forster resonance energy transfer (FRET) measurements, total internal reflection fluorescence microscopy (TIRFM), backscattering interferometry (BSI), absorption, spectroscopy, AlphaScreen® assays, microscale thermophoresis (MST), patch clamp measurements.

Preferably, the particles to be analyzed are provided in a liquid, preferably in an aqueous solution. Surface-based methods are generally dependent on that the particles to be analyzed can reach the surface of the liquid or the surface of a sample chamber for an extended period of time, i.e. the measurement period and/or the incubation time or process time. In view of the finite concentration of the particles in the liquid and of the limited diffusion constant (diffusion rate) of the particles, a so-called "depletion layer" (see e.g. J. Mol. Recognit. 1999; 12:293-299) frequently forms at the surface and/or the boundary surface. This depletion layer may lead to a distortion of the measurement results and/or to a slowdown of the reaction and/or of analysis at the surface. Accordingly, in specific applications, e.g. the measurement of the $k_{off}$ rate (dissociation rate), where it is measured how and how fast the particles previously bound to the surface (e.g. antibodies) dissociate themselves therefrom and form a "concentration layer" of the dissociating particles. This concentration layer may cause an undesirable so-called "re-binding" of the dissociating particles. Both the depletion layer and the concentration layer may cause a distortion of the measurement results for the following reasons:

a) Binding (measurement of the binding rate/binding kinetics), depletion layer interfers.

Here, a solution consisting of a buffer and dissolved/dissociated particles A of concentration [A] to be analyzed is introduced into the sample chamber. The binding kinetics are expressed by the rate gamma. $\gamma=k_{on}*[A]+k_{off}$, i.e. when particle A-containing buffer is added, the binding rate (association rate) $k_{on}$ cannot be measured independently of the dissociation rate $k_{off}$. It is only possible to measure an apparent rate gamma, which, however, is dependent on the concentration [A]. However, it is frequently necessary to determine the concentration-independent rates $k_{on}$ and $k_{off}$. Therefore, b) is necessary, too.

In a), the depletion layer interferes (binding, association); in b), the concentration layer interferes (dissociation).

b) Measurement of dissociation/dissociation rate $k_{off}$, concentration layer interfers (see, for example, also "Blocking rebinding with soluble receptor" in J. Mol. Recognit. 1999; 12:293-299).

Since, as described in a), it is not possible to measure $k_{on}$ and $k_{off}$ independently of each other, a second experiment is required with which it is possible to individually determine $k_{off}$ and then, together with a) or a repeated measurement of a) at different concentrations [A], to determine $k_{on}$.

Here, only the buffer, without particle A, is given into the sample chamber in which previously the binding of A was measured. In the sample chamber, A is present and bound to the surface. Attempts are then made to wash A away or to dissociate it so as to be able to measure the pure $k_{off}$ of A. Thus, if pure buffer is given into a sample chamber wherein A is bound to the surface (or bound to the molecules B immobilized there), then a new chemical equilibrium must be reached (the previous chemical equilibrium was reached for an A-containing buffer), which causes dissociation of the molecules A. If the dissociating molecule A is transported off rapidly enough, it cannot bind again to the surface (this would lead again to the measurement of gamma, i.e. $k_{on}$ and $k_{off}$ at the same time) and it is therefore possible to measure the pure $k_{off}$ rate. If A is not transported off rapidly enough, a concentration layer is formed. The values $k_{on}$ and/or $k_{off}$ are usually expressed by the units: $k_{on}$: 1/([s]*[M]) and/or $k_{off}$: 1/[s].

With known methods it is attempted to reduce the depletion layer and/or the concentration layer through a constant liquid flow, which is produced, for example, by external pumps. This approach has the considerable disadvantage that through the external pumps, valves and/or tubes a large dead volume is created, and that the whole system is rather error-prone. In addition, leaks, contamination of the tubes and valves, and cross-contamination through old samples which could not be completely removed may cause further measurement errors. Since to users often only very little or very expensive sample material is available, the above discussed dead volumes are a considerable economic disadvantage. Moreover, mostly apparatuses that are rather large/voluminous and difficult to transport are advantageous for controlling and regulating the pumps and valves and thus the liquid flow. This may prevent, inter alia, their use in "point of care"/"point of need" diagnostics.

Another method with which a depletion layer is to be prevented, moves or "shakes" the sample chamber macroscopically vis-à-vis a surface sensor. However, one problem with this method is that the sample chamber must be open towards the outside, so that the aqueous solution may evaporate and/or be contaminated by external influences. The mechanical "shaking" of the open sample chamber is also problematic since this shaking may cause liquids to overflow/"spill over" so that they may also infiltrate adjacent open sample chambers.

In addition, reference is made to German patent specification DE 103 25 307 B3 disclosing a method for mixing liquids in a microcavity by utilizing sound-induced flows.

It is an object of the present invention to reduce or overcome, in particular, the above-mentioned disadvantages of the prior art and to provide a new, preferably more advantageous method as well as a corresponding apparatus and system.

SUMMARY OF THE INVENTION

This object is achieved with the features of the independent claims. Further preferred embodiments can be taken from the sub-claims and the following aspects and/or exemplary embodiments.

The present invention generally relates to a method for the mixing of fluids, preferably liquids, and for the mixing of particles in a fluid or liquid. Preferably, the invention relates to a method for mixing particles dissolved and/or undissolved in said liquid. The present invention generally relates to the mixing of any kind of particles, such as bio(molecules), nano(particles), (micro)beads, (bio)polymers, paints, emulsifiers, cells (biological cells), viruses, bacteria, lipids, vesicles, liposomes, nanodiscs, pigments, dispersing additives, pastes.

Preferably, the liquid is provided as volume of liquid in at least one sample chamber, with the sample chamber either being open or closed. As alternative to a sample chamber, the liquid may also be provided in the form of a drop. According to the invention, a thermal convection flow is produced within the drop. For example, the drop of liquid may be provided on a suitable object carrier (see discussion below) and, for example, may be enclosed by a layer of oil to prevent evaporation. According to a preferred embodiment, already the provision of very small volumes of liquid in glass capillaries is sufficient.

Independently of whether the liquid containing (dissolved or undissolved) particles is provided for measurement within a sample chamber or within a drop, according to the invention a convection flow is achieved in the volume of liquid by irradiating electromagnetic radiation into the volume of liquid, and, in particular, by mixing the liquid with the particles present therein at a surface of the volume of liquid or at a boundary surface or boundary layer between the volume of liquid and a material layer of the sample chamber. Therefore, the method of the invention and the corresponding apparatus can be used for measuring methods wherein preferably the measurement is made at the surface or boundary surface of a liquid, since according to the invention a depletion zone, a depletion layer, a concentration zone, a concentration layer or a shift in concentration at the surface or the boundary surface is avoided.

It is an object of the invention to achieve in particular a good mixing in contact surfaces between solids (such as the inner surface of a sample chamber or of glass capillaries) and the liquid. A surface or contact surface of the invention is, however, not restricted to a flat surface but may also be three-dimensional or fractal, e.g. when dextran-coated or dendrimer-coated glass substrates are used and the interaction occurs between, e.g., antibody and antigen at/in the dextran layer.

Preferably, the thermal convection flow is generated with the assistance of at least one electromagnetic radiation source, preferably a light source, and further preferably by an infrared (IR) radiation source. For example, IR radiation can be produced with known IR radiation sources and locally positioned and also focussed in the liquid, preferably by optical means (for example a lens and/or a mirror/reflector). Depending on the experimental setup of the invention or the application it may also be advantageous to parallelize the IR beam or even to defocus it (divergent). According to the invention, IR diodes, IR LEDs and IR lasers may also be used as radiation source.

In particular, the liquid is preferably heated locally at the site of the irradiated beam, and the thermal convection flow generated in this way. In other words, the present invention preferably directly generates liquid flows, and preferably by purely optical means, and, in particular, completely contactless directly in the particle-containing liquid/solution. Since the liquids to be analysed are frequently aqueous solutions, it is in these cases particularly advantageous to choose the electromagnetic radiation in the infrared wavelength range, due to its advantageous absorption behavior. In particular, it is preferred to use infrared radiation, more preferably infraread (IR) laser radiation, which is strongly absorbed by water (aqueous solutions) (see also FIG. 1).

In addition, the inventors of the present invention have found that an aqueous solution not only absorbs the energy of the IR laser radiation but that also the photon impulse of the IR laser radiation (light pressure) has an influence on the convection behavior (see FIGS. 2A, 2B). By energy absorption, the aqueous solution is heated locally at the site where the IR laser radiation irradiates into the aqueous solution, which leads to thermal convection. Moreover, by absorption the photon impulse of the IR laser radiation is also transferred to the aqueous solution. Through this light pressure (or radiation pressure), the flow rate of the thermal convection can be increased (antiparallel to gravitation) or decreased (parallel to graviation) depending on the orientation of the IR laser radiation relative to the vector of gravitation. The laser radiation may also be directed vertically or diagonally to gravitation.

The wavelength of the preferred IR radiation is preferably in the range of from 1,200 nm to 2,000 nm. Further preferred are the specific IR laser wavelengths: 980 nm (+/−10 nm); 1,450 nm (+/−20 nm); 1,480 nm (+/−20 nm); 1,550 nm (+/−20 nm) and 1,920 nm (+/−20 nm).

The invention further relates to an apparatus for implementing the method of the invention. In particular, the method of the invention is preferably used in combination with surface-based/boundary-based measuring methods/measuring apparatuses. Thus, it is, for example, possible to safely and reliably analyze specific chemical, biochemical interactions at boundary surfaces, preferably in extremely small volumes. Beside specific interactions of particles with boundary surfaces it is also possible to analyze unspecific effects, such as "adhesive bonding", physisorption, chemisorption, sorption, adsorption, absorption, electrochemical methodes, catalytic methodes, etc.

Thus, the mixing method of the invention may, for example, be used in combination with measuring apparatus(es) for determining optical properties at a thin film/layer, whereby it is possible, for example, to detect chemical, biochemical, medical and/or physical reactions, binding and/or annealing processes as well as other interactions at the thin film/layer. In known measuring methods, for example, light, preferably light of a specific wavelength, is irradiated at a sample to be analyzed, with the sample being bound to a thin film/layer. Changes in the optical film/layer thickness are detected or measured, for example, by means of interference phenomena, from which it is possible to draw conclusions as to the reactions of the analyzed sample with a corresponding pretreated thin film/layer (the terms film and layer are interchangeably and synonymously used).

A further advantage of the method of the present invention consists, for example, also in that there is no dead volume. According to the invention it is possible to reduce the volume consumption of from some 100 microliters to some milliliters to from some nanoliters to some microliters. According to the invention, preferably volumes of from 1 microliter to 10 microliter are used. Complex flow cells, microfluidic systems, pumps, valves and tubes are preferably dispensed with. Therefore, an apparatus according to the invention is rather robust and preferably cannot be contaminated by any residues in tubes and/or valves, and it also prevents the loss of the sample/the particles in the sample by bonding (adsorption/chemsorption/physorption) of the particles at the surfaces of the tubes and valves (in more general terms: at the surfaces of the dead volumes).

Since the liquid flows are preferably generated completely without contact, by purely optical means, a cross-contamination and/or contamination of the samples can be reduced and, preferably, even be ruled out. According to the invention, both open and closed sample chambers are used. Through closed sample chambers it is, moreover, possible to prevent evaporation of the (aqueous) solution. This is advantageous, for example, because thus significantly longer measuring periods are possible.

Convention is generally caused by a flow which is capable of transporting particles. The transporting flow can basically be caused by different forces, such as weight or forces resulting from differences in pressure, density, temperature or concentration. A distinction is made between forced convection, where the particle transport is caused by external influences, such as a blower or a pump, and free or natural convention, where the particle transport is preferably exclusively caused by the effects of the temperature gradient. The method of the invention preferably produces a free or natural convection, i.e. convection caused by a temperature gradient. The increase in temperature is preferably small enough so as not to damage and/or negatively affect the particles and/or the sample.

A free convection due to thermal density differences may, for example, be described as follows: Substances generally expand upon heating (except the anomalous density of water). Under the influence of the graviational force, areas with lower density ascend within a liquid against the gravitational field (buoyancy), while areas with higher density descend therein. If, for example, heat is supplied at the bottom of a sample chamber and if at the top there is the possibility of cooling, there will result a continuous flow. The liquid is heated, expands and ascends. When the liquid reaches the top it cools off, contracts again and descends, and is heated again at the bottom.

The velocity of the liquid flows of the thermal convection according to the invention may preferably be changed or controlled by varying the optical energy or output, focusing or defocusing, the intensity, direction, parallelism (or also convergence and divergence) and/or the position of the focus relative to the surface/thin film/layer to be analyzed, the number of beams (a laser beam may be divided so as to heat several places at the same time), the irradiation duration, the pulse width modulation (pulse height, pulse duration, repeat rate), the wavelength, the velocity of the moving beam, the irradiated radiation and/or in dependence on the irradiation direction relative to gravitation. The position of the irradiated radiation (e.g., the position of the focus of the irradiated radiation) may vary; the focus may, e.g., be positioned by means of mirror systems (cf. laser scanner) in all three dimensions and moved at different velocities. Since it is possible with the present invention to also generate liquid flows vertical to the surfaces of sample chambers by means of optically generated thermal convection (as opposed to liquid flows generated by external pumps), the mixing of the liquid and the reduction of a depletion layer is very efficient.

The rate of thermal convection is inter alia dependent on the chamber thickness (height in the direction of gravitation) of the sample chamber, and, in particular, on the chamber geometry. In particular, lateral faces of a sample chamber may significantly affect the rate of thermal convection. Preferred are sample chambers which are thick enough (e.g., >0.05 mm) for achieving a desired rapid flow rate of the thermal convection in order to avoid a "depletion layer" or a concentration layer.

According to the invention it is particularly preferred to achieve a thermal convection in such a way that preferably a laminar flow is generated, preferably at small Reynolds numbers (Reynolds number Re <1,000). Preferably, sample chambers (including drops of liquid or water) with a volume of ≤200 μl (microcavity) are used. In addition, a film/layer thickness of at least 0.05 mm is preferred since with lower film/layer thicknesses or lower thicknesses of the sample chamber the convection effect is too weak for achieving a desired mixing. It is also preferred to use film/layer thicknesses of the liquid or thicknesses of the sample chamber that are not larger than 11.5 mm (well depth at multi-well plates).

An exemplary convection rate in a sample chamber that is in the form of a disc and has a height of 1 mm and a diameter of 5 mm, a volume of 20 μl, a chamber temperature of 52° C., an IR laser with 1,480 nm at an irradiated light output of 75 mW lies at a mean rate of approximately 0.4 mm/s A typical or average expansion of the convection flow lines in this example lies at a diameter of approximately 2 mm.

With the following geometry of the sample chamber: disc having a height of 0.05 mm and a diameter of 5 mm; chamber temperature: 20° C.; IR laser: 1,480 nm; temperature increase through IR laser radiation: 1.25 K; the typical/mean convection rate is approximately 0.0005 mm/s when the IR laser radiation is directed anti-parallel to gravitation, i.e. when it supports/promotes thermal convection.

In the following we will discuss a comparison of the convection rate with the diffusion rate of the particles. This comparison shows, e.g., that a finite, and therefore too slow, diffusion may cause the problem of a depletion layer or a concentration layer. Exemplary diffusion constants D of biomolecules are from 1 $\mu m^2/s$ to 400 $\mu m^2/s$.

Preferably, the moving/displacement/mixing of the particles occurring on the basis of the convection flow is adapted to the particle movement (Brownian motion) due to their diffusion (diffusion constant D). Depending on the diffusion constant of the particles to be analyzed, there is a preferred mean flow rate of thermal convection, and thus, for example, there are also preferred radiation intensities or configurations for the irradiation of the radiation. In view of the setup of the invention, which is extremely flexible, easily variable and preferably purely optical, the convection flow, and thus the mixing can preferably be adjusted for the particles to be analyzed without that a new setup must specifically be built for each particle.

The inventive method for the mixing/stirring of liquids can particularly advantageously be used in analytics, in particular in analytical methods wherein the binding kinetics of biomolecules may be relevant (e.g. association and dissociation rate constants; $k_{on}$, $k_{off}$, also called rates for the forward reaction ($k_{on}$) and the reverse reaction ($k_{off}$)) and the binding affinity, expressed, for example, by the dissociation constant $K_d=k_{off}/k_{on}$. By way of example, these rate constants may be described as follows. Assumed is a chemical reaction of molecule A of concentration [A] with molecule B of concentration/surface density [B] to complex D of concentration [D]. The kinetics of this reaction, i.e. the kinetics of complex formation can be expressed by the following equation, which thus also shows the relevance of the rate constants:

$$\frac{d}{dt}[D(t)] = k_{on} * [A(t)] * [B(t)] - k_{off} * [D(t)]$$

Further examples of the application of the inventive mixing are "diagnostics" (mixing is also relevant in ELISA), the field of electrochemistry, the field of catalysts, or the field of quality control (to detect "bonding" to surfaces in order to avoid it). In addition, it is possible to measure rates of "bonding" of particles or to measure the strength of "bonding" ("bonding", physorption, chemsorption, adsorption, absorption). Mixing by optically generated thermal convection may also be advantageous for 96-well plates or other reaction vessels, for example when it is not possible to use mechanical shakers or other mixing devices, such as magnetic agitators, for reasons of, e.g., contamination prevention.

Even in multi-well plates (area of application: ELISA), mixing by means of optically generated thermal convection is advantageous. In 384-well plates and/or 1536 well plates, the adhesive forces of the liquid to the well surfaces (microcavities) are so large that the liquid in the wells is no longer thoroughly mixed on a shaker/vibrator.

With an IR laser which, e.g., is only used for a few seconds in each well, it is possible to achieve a better mixing in the well (volume <200 μl). It is also possible, especially in this application, to generate thermal convection for mixing by means of IR-LEDs. IR-LEDs are favourable; it is, for example, possible to use 384 LEDs or 96, or 26 or 16 to mix a large number of wells at the same time. Typically, IR-LEDs have less luminous power than IR lasers; however, since the film thickness of the aqueous solution in the wells is rather large (typically >1 mm), absorption of the IR radiation is rather high (Beer-Lambert Law) so that even IR-LEDS are powerful enough.

Generally, the method of the invention is advantageous for reaction kinetics measurements or biomolecular analytics. In particular, the method of the invention can be used with NanoTemper® capillaries (such as glass capillaries having an inner diameter of from 0.05 mm to 0.8 mm), preferably at inner diameters of 0.2 mm, 0.35 mm, 0.5 mm and 0.8 mm, and external diameters of smaller than 1.0 mm. Preferably, no flow cells are necessary and the capillaries can be filled purely passively by capillary forces. The inner surface of the glass capillaries may or may not be untreated or at least partly specifically coated/modified (e.g. with antibody, antigen, DNA, RNA, PNA, TNA, proteins, peptides, etc.).

The inventive method can generally be implemented with sample chambers or object carriers which have at least one section that is transparent. In physics, transparency is the capability of matter to allow electromagnetic waves to pass through (transmission). In everyday life, the term is mostly used with reference to light, i.e. to the spectral range of electromagnetic radiation visible to humans. According to the invention, the transparent material is preferably transparent in a wavelength range of from 200 nm to 2,000 nm, i.e. preferably also for infrared light and/or UV light. The transparent material is preferably transparent for light in the range of from 200 nm bis 900 nm, preferably of from 250 nm to 900 nm, preferably of from 275 nm to 850 nm. Preferably, the transparent material is also transparent for light of the following wavelengths: 940 nm to 1,040 nm (preferably 980 nm+/−10 nm), 1,150 nm to 1,210 nm, 1,380 nm to 1,600 nm (preferably 1,450 nm+/−10 nm and/or 1,480 nm+/−10 nm and/or 1550 nm+/−10 nm), 1,900 nm to 2,000 nm (preferably 1,930 nm+/−10 nm).

Moreover, it may even be sufficient if merely 10% of the irradiated light is allowed to pass through the transparent material, preferably at least 20%, 30%, 40%, 50%, 60%, 70%, 80% or at least 90% or more.

The transparent material may, for example, comprise glass and/or a polymer. Possible materials also include borosilicates or borosilicate glass, such as borosilicate glass 3.3 (such as DURAN glass), quartz glass, such as Suprasil, Infrasil, synthetic quartz glass or silica glass, soda lime glass, Bk-7, ASTM type 1 class A glass, ASTM type 1 class B glass. The polymer may comprise PTFE, PMMA, Zeonor™, Zeonex™, Teflon AF, PC, PE, PET, PP (polypropylene), PPS, PVDF, PFA, FEP, and/or acrylic glass.

The method of the invention may also be used with pipette tips, in particular with at least partly transparent pipette tips, for example from polypropylene. The process of the invention may also be used with reaction vessels, such as reaction vessels from glass or plastics ("Eppis"), preferably transparent glass and plastics. For example with reaction vessels for "Realtime PCR (polymerase chain reaction)". The method of the invention may also be used with chambers/capillaries for electrophoresis, preferably capillary electrophoresis. The method of the invention may also be used in the detection range of HPLC/UHPLC (high performance liquid chromatography, HPLC). The method of the invention may also be used with microfluidic chambers/microfluidic chips. The method of the invention can be used with closed/sealed multi-titer plates (multi-well plates) that have a transparent base and/or cover.

The method of the present invention can also be carried out with multi-titer plates (multi-well plates) that do not have a transparent floor. However, it is preferred that multi-titer plates (multi-well plates) are open, preferably open at the top, for filling with pipettes or pipetting robots.

The method of the invention can be used in welded/sealed ampoules, for example glass ampoules or plastics ampoules, preferably transparent ampoules. The ampoules may, for example, enclose substances for forensic or diagnostic tests, which must not be contaminated and, therefore, should preferably not be opened.

The method of the invention may, for example, used everywhere where mixing/flow generation by means of an external flow (pumps) and/or mechanical shaking is not possible (for example all closed reaction vessels/microcavities) or useful, but where the aqueous solution is optically accessible.

The method of the invention may be used in diagnostics, also for mixing in ELISA plates. A further exemplary field of application is quality control.

The method of the invention for mixing can be combined with a plurality of different known measuring or reading techniques, in particular for measuring specific and unspecific interactions of particles at surfaces/boundary surfaces. The following typical surface techniques are mentioned by way of example: For measuring, methods are used, such as, reflectrometric interference spectroscopy (RIfS), bio-layer interferometry (BLI), surface plasmone resonance (SPR), quartz crystal microbalance (QCM), surface acoustic wave (SAW), enzyme linked immunosorbent assay (ELISA), or even nanopores or transistors (next generation sequencing). For example, it is possible to improve these measurement methods by a combination of, e.g., glass capillaries of defined diameters as sample chamber of the aqueous solution containing the particles, IR laser/LED for generating a thermal convection in the aqueous solution in the glass capillary, and a corresponding measuring or test arrangement.

In general, the present invention first relates to a method for mixing of liquids or particles with a liquid, comprising the steps: providing a volume of liquid and generating a thermal convection flow at at least one surface/boundary surface of the volume of liquid by irradiating electromagnetic radiation into the volume of liquid.

The volume of liquid may, for example, be provided in a sample chamber that is open or closed. Preferably, a microcavity, or, further preferably, a capillary or pipette tip, may be used as sample chamber. A sample chamber should preferably comprise at least one section that is at least partly transparent. Preferably, the sample chamber has a thickness of from 0.01 mm to 25 mm, preferably of from 0.05 mm to 12 mm, preferably of from 0.05 mm to 1 mm. According to a preferred embodiment, capillaries have an inner diameter of from 0.01 mm to 3 mm, preferably of from 0.05 mm to 0.8 mm, with the capillaries being preferably made, at least in part, from glass or other at least partly transparent materials. The volume of liquid may also be provided as drop(s) on an object carrier.

The sample chamber has preferably a volume of from 0.001 μl to 1,000 μl, preferably of from 0.1 μl to 200 μl, preferably of from 1 μl to 10 μl, preferably of from 1 μl to 6 μl.

The surface of the volume of liquid is preferably formed by the boundary between the volume of liquid and a surface of the sample chamber or, for example, by the boundary between volume of liquid and a surface of the object carrier.

The liquid used is preferably an aqueous solution, without, however, being limited thereto.

The electromagnetic radiation preferably comprises IR radiation or just wavelengths in the IR range and is preferably produced by a laser and/or an LED.

The irradiated radiation may be directed parallel and/or antiparallel to gravitation and/or contain a component that is directed vertical to gravitation.

The irradiated radiation preferably produces a temperature gradient of from 0.001 K/μm (=1 K/mm) to 5 K/μm (=5,000 K/mm), preferably of from 0.001 K/μm (=1 K/mm) to 2 K/μm (=2,000 K/mm).

More preferably, the temperature gradient is produced in a small range, preferably in a range of from 0.00001 $mm^2$ to 1 $cm^2$, preferably in a range of from 0.0001 $mm^2$ to 12 $mm^2$.

A detection region for measuring the properties of the liquid or of the particles in the liquid can be spaced from the region where the radiation is irradiated. For example, the detection region may be spaced at least 0.01 mm from the irradiated beam, with the distance being preferably measured vertically to the irradiation direction.

According to a further embodiment, the detection region and the irradiation region may also overlap. Thus, the detection surface is often larger than a well focused laser beam (for example, it is possible to obtain a 2 μm diameter with IR). Therefore, in this embodiment, the entire detection surface is preferably swept by the convection flow. The overlap of the detection region and the irradiation region is, for example, applicable in the setups of FIG. 5 or FIG. 6. Since everything is focused through the same lens system, the heating focus of the IR radiation is preferably within the detection region.

Preferred flow rates of the convection flow are in the range of from 0.0001 mm/s to 10 mm/s, preferably of from 0.0005 mm/s to 2 mm/s.

The inventive method for mixing is particularly advantageous when combined with additional measuring methods. In particular, the present invention also relates to a method for analyzing molecular interactions at and/or in a thin film in a volume of liquid, comprising the steps of: providing at least one volume of liquid with particles present therein on an object carrier or in a sample chamber and irradiating electromagnetic radiation into the volume of liquid for generating a thermal convection flow, measuring a specific or unspecific interaction of the particles with a surface/boundary surface of a sample chamber or an object carrier, and preferably characterizing the interaction of the particles based on the measurement.

Preferably, a sample chamber for implementing such a measurement is provided in the form of a capillary, a pipette tip, a multi-well plate or a microfluidic chip.

The interaction is preferably measured by reflectrometric interference spectroscopy (RIfs), surface plasmone resonance (SPR), enzyme linked immunosorbent assay (ELISA), quartz crystal microbalance (QCM), and/or surface acoustic wave (SAW). According to further preferred embodiments, the interaction may be measured by at least one method from the group consisting of: reflectrometric interference spectroscopy (RIfs), bio-layer interferometry (BLI), surface plasmone resonance (SPR), quartz crystal microbalance (QCM), surface acoustic wave (SAW), enzyme linked immunosorbent assay (ELISA), nanopores or transistors (next generation sequencing).

The present invention also relates to an apparatus for mixing liquids or particles with a liquid, in particular for implementing any of the methods described above, comprising: means for receiving a volume of liquid; a source for emitting electromagnetic radiation, and means for irradiating the emitted electromagnetic radiation into the volume of liquid.

Finally, the present invention also relates to a system comprising an apparatus for mixing and an apparatus for measuring, with the measuring means being preferably used for measuring a specific or unspecific interaction of the particles with a surface/boundary surface of a sample chamber or an object carrier.

SHORT DESCRIPTION OF THE FIGURES

In the following, preferred embodiments of the present invention are described in detail with reference to the Figures.

FIG. 1 shows an exemplary IR absorption spectrum of water or an aqueous solution with shown absorption maxima;

FIGS. 2A & 2B schematically show the influence of the orientation of an irradiated IR laser beam relative to gravitation on the generated thermal convections;

Figure 7:
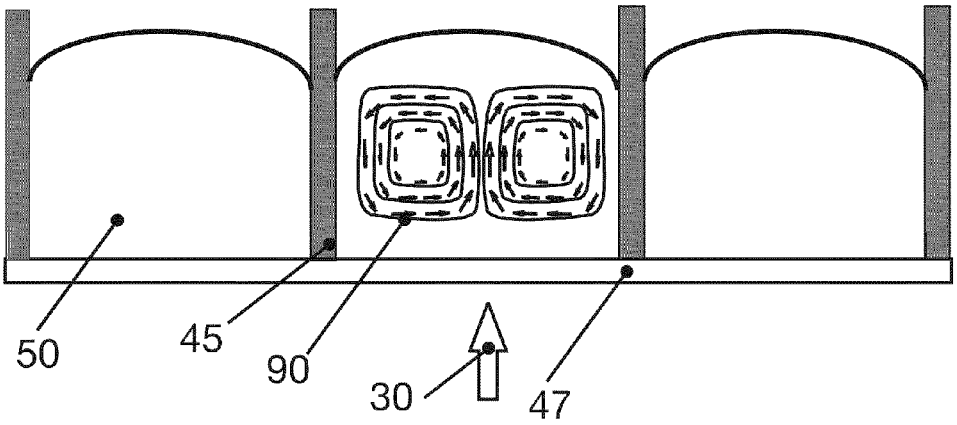
Figure 7:
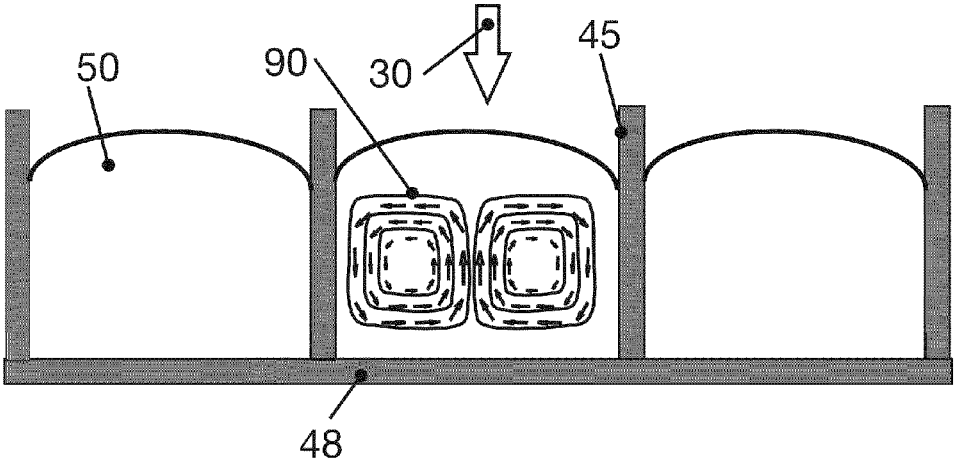
Figure 8:
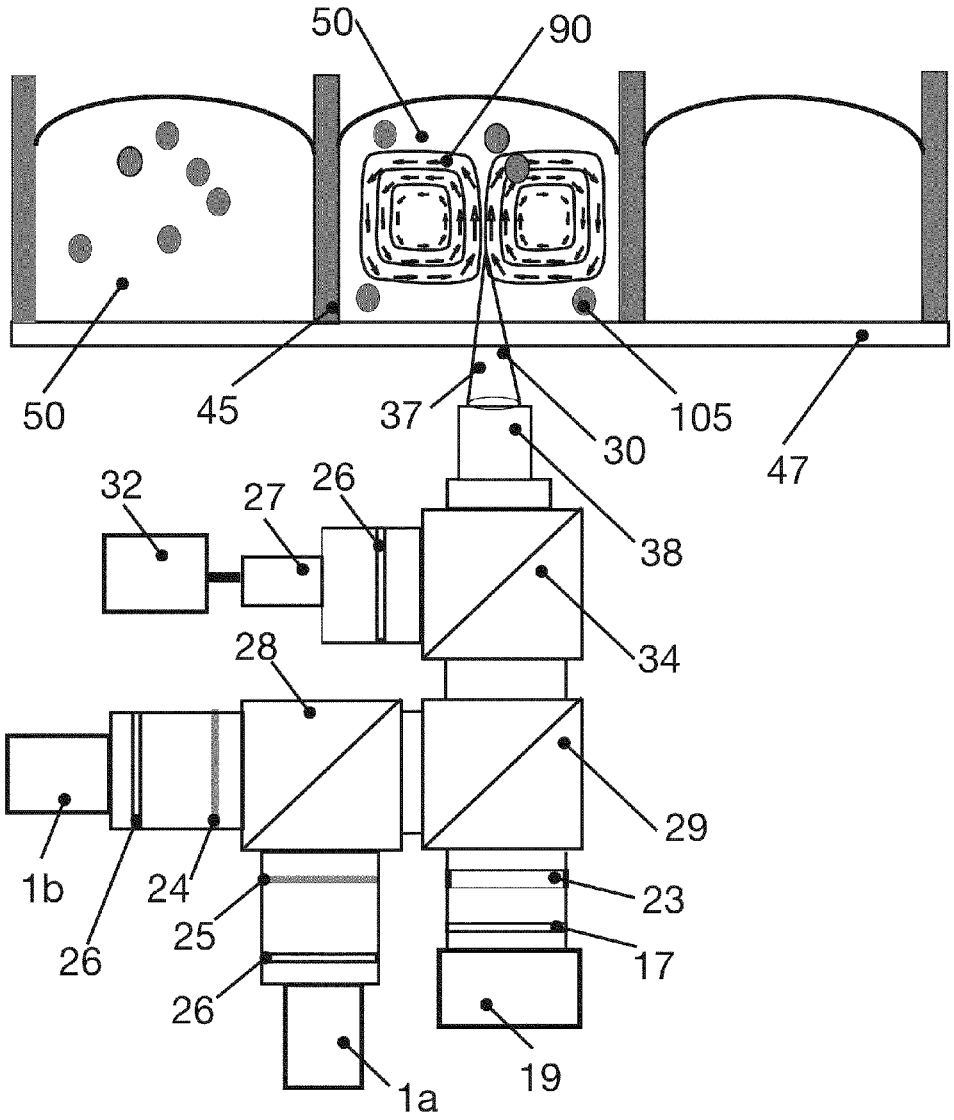

FIGS. 7A & 7B show schematic representations of the irradiation of IR radiation into multi-well plates; and FIG. 8 shows a schematic representation of an exemplary test arrangement according to the invention for measuring multi-colored (multiplexing) fluorescence in a multi-well plate in which fluorescence excitation and fluorescence detection as well as IR radiation focussing is effected by the same optical system.

DETAILED DESCRIPTION OF PREFERRED EMBODIMENTS

Figure 3:
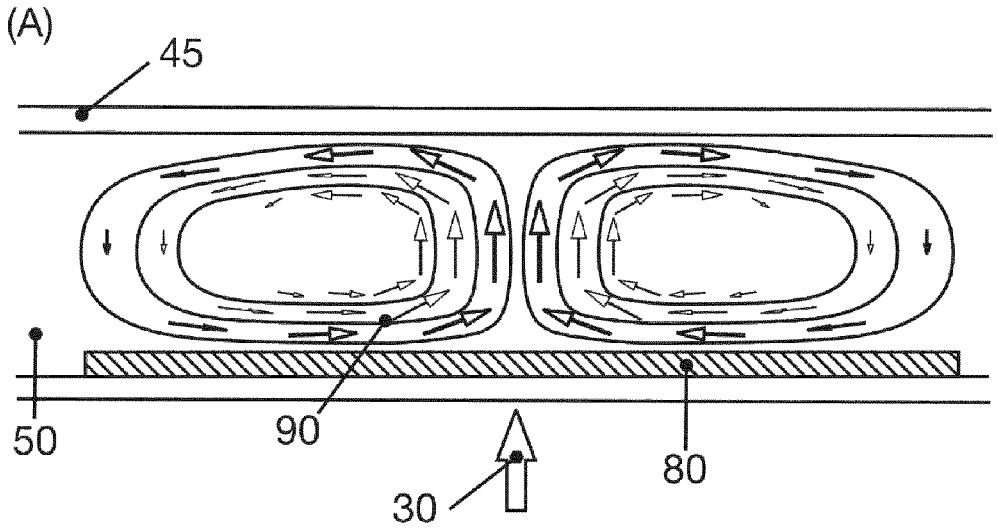
FIG. 3 shows a schematic representation of the preferred detection region for measuring the specific and unspecific interaction of particles within a sample chamber.

FIG. 3 shows, by way of example, the detection region 80 for measuring the specific and unspecific interactions of particles. The shown sample chamber 45 is, by way of example, a capillary.

The detection region 80 is preferably located at the surface/boundary surface of the measurement volume within the capillary 45, i.e. on the inside of sample chamber 45. The detection region 80 may, for example, be selected around the region of an irradiated IR radiation 30 such that it is smaller, larger or has the same size as the surface swept by the thermal convection 90.

The detection region 80 may, for example, be a thin film and contain, for example, antibodies for the specific detection of antigens. In other words, the detection region is located at the surface of the liquid or at the surface of the capillary 45. The detection region 80 may, for example, also be composed of a plurality of differently thin films, which differ, for example, in their refractive index, polarizability or their fluorescence. The convection is preferably adjusted such that it transports particles from far outside the detection region, for example, from some millimeters away, into the detection region.

It is possible to vary the order; the decisive factor is that there is a specific distance between IR laser focus (determining the "convection rolls") and the place where the interaction at the surface is detected. The distance between both is important since, depending on output and chamber thickness and chamber geometry, the IR laser will generate different thermal convection flows. The whole setup must be controlled such that the correct thermal convection flows are present at the point where the interaction is observed (for preventing a depletion layer of the molecules).

Figure 4:
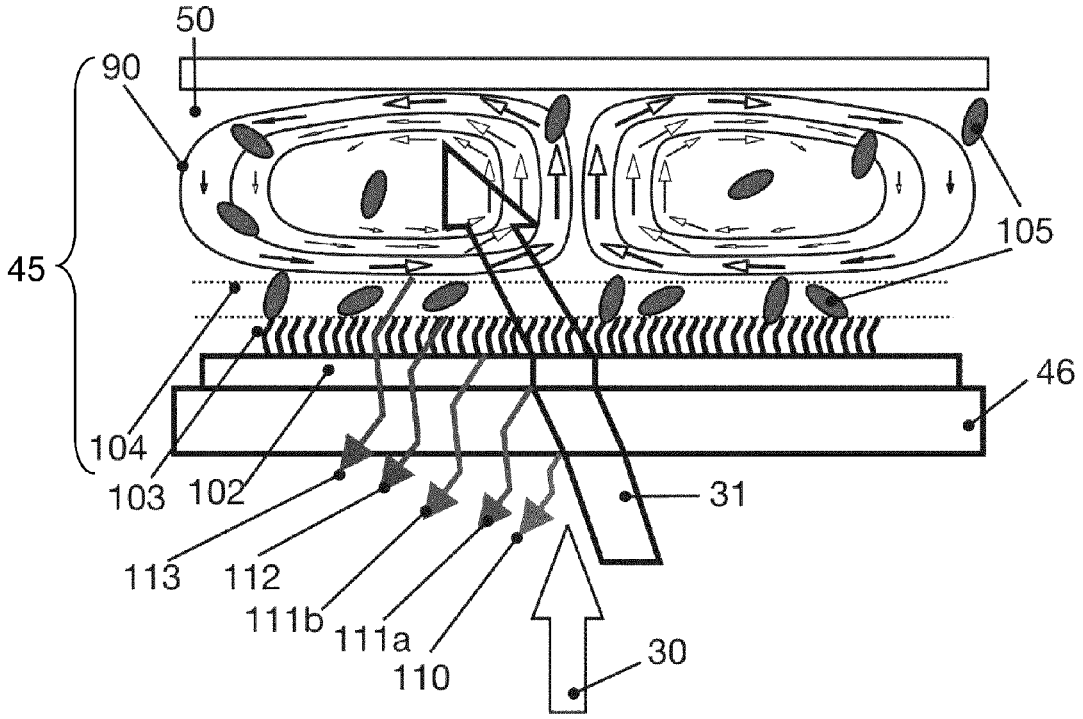
FIG. 4 shows a further embodiment of an arrangement for the method of the present invention wherein in particular the beam path of the respective light beams is schematically shown.

FIG. 4 shows an exemplary arrangement in which the method of the invention is used. Here, infrared laser radiation 30 is irraditated from below into a sample chamber 45 with a volume of liquid, here an aqueous solution with particles 50, and generates a thermal convection 90 in the sample chamber 45. The flow rates in the liquid are represented by corresponding vectors. Moreover, a symmetrical convection around the irradiated laser beam 30 is discernible in this example. The reflectometric interference spectroscopy (RIfs) method is used as detection method for measuring the interaction of the particles 105 dissolved in the liquid with a thin film (hatched) of functionally immobilized molecules/particles 103.

In summary, the RIfS is a physical method based on the interference of white light at thin films. This method is used in practice, e.g., for analyzing molecular interactions. The underlying measuring principle corresponds to the Fabry-Pérot interferometer. RIfs is primarily used as detection method in chemosensors and biosensors. As sensitive layers, mostly non-selectively measuring polymers are used which sort analytes either according to their size (the so-called molecular sieve effect with microporous polymers) or on the basis of different polarities (e.g., functionalized polydimethyl siloxanes). In the field of biosensors, for example, polymers, such as polyethylene glycols or dextranes, are applied to the layer system, and identification structures for biomolecules are immobilized thereon. Generally, all substance classes can be used as identification structures (proteins, such as antibodies; DNA/RNA, such as aptamers; small organic molecules, such as Estron; but also lipids, such as phospholipid membranes).

Additionally, FIG. 4 shows a carrier 46 which may be component of the sample chamber 45. However, it is also possible that the sample to be analyzed is provided on the carrier as drop or liquid film. The carrier 46 may be made, for example, from glass or plastics. On this carrier 46, the thin film to be analyzed, comprising a layer 103 of functionally immobilized molecules and a further layer 102 of molecules which is arranged between the layer 103 and the carrier 46, is schematically represented. The layer 102 serves, in particular, for better adhesion of the thin film on the carrier 46. The film/layer 102 of molecules (e.g., PEG or dextrane, etc.) which is arranged between the layer 103 and the carrier 46 (schemically represented) may, for example, serve as spacer and/or as immobilization means for the functional molecules of film 103. In particular, the layer 102 is also used for a better adhesion of the layer/thin film 103 on the carrier.

Sample particles 105 may adhere/bond to the functionally immobilized molecules/particles of layer 103. As a consequence, the thickness of the thin film increases, the distance of its upper boundary surface 104 from the phase boundary between thin film and carrier (or from the lower boundary surface of the thin film) increases. After adhesion/bonding of the sample particles 105, light 31 irradiated from below, which is used for measuring, is now also reflected at the boundary surface 104. The boundary surface 104 is formed with respect to the solution with particles 50, for example, when the particles from the aqueous solution bind to the functionally immobilized molecules in the thin film 103. The reflected beam 113 at this boundary surface 104 is schematically shown. Further shown are the reflected beams 112, 111*a*, 111*b* and 110 which are reflected at boundary surfaces lying under the boundary surface 104. Since the irradiated light has to travel a longer path length to the boundary surface 104, this causes a displacement of the interferogram which is generated by superposition of the reflected electromagnetic radiation 110, 111*a*, 111*b*, 112 and 113. It is possible to measure this displacement time-resolved, which allows exact conclusions as to the change in film thickness and thus to the interaction between the disassociated/dissolved particles 105 and the functionally immobilized particles 103.

For example, the particles 105 in the aqueous solution are biomolecules, such as DNA, RNA, proteins, antibodies, antigenes, etc., small molecules, nanoparticles, polymers, peptides, PNA, etc., or even cells, viruses, bacteria, vesicles, liposomes, microbeads, nanobeads, nanodiscs, etc.

Figure 5:
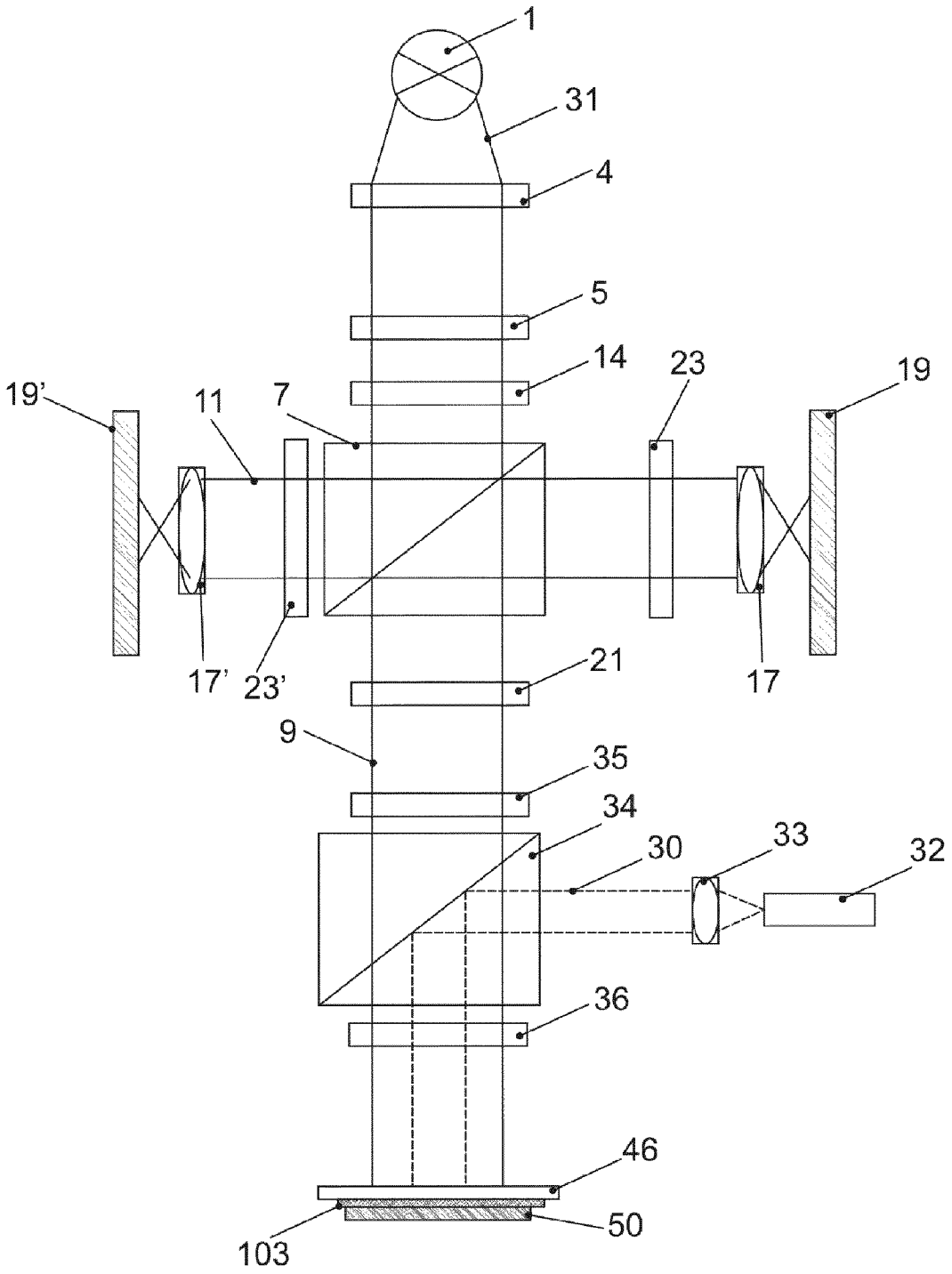
FIG. 5 shows a schematic representation of a test arrangement according to the present invention for measuring specific and/or unspecific interactions of particles with a surface.

FIG. 5 shows, by way of example, the use of the method of the invention in a specific test arrangement, without, however, being limited thereto. The reference numeral 1 designates a light source that is used for the measuring. For example, the light source 1 can be one or more LED(s), one or more laser(s) and/or one or more SLED(s) (superluminescent LED). The light of the light source 1 is primarily used for irradiating a sample 50 to be analyzed, preferably for vertically irradiating it. The light emitted from the light source 1 can be changed by known optical means, for example by a diffusor 4 and/or a lens system (not shown). A diffusor 4 may, for example, be used for evenly distributing the light, and a lens system may be used for concentrating the light as desired. In this embodiment, the light subsequently passes a polarizer 5, e.g. for generating linearly polarized light. In addition, the light may also cross a filter 14, so that a light beam 31 with defined properties is irradiated on the sample 50. The filter 14 may be, for example, a wavelength filter, such as a band-pass filter, or a long pass filter or a short pass filter.

The beam splitter 7 in the embodiment shown is used for splitting the beam of light into a measuring beam or measuring beam path 9 and a reference beam or reference beam path 11, with the measuring beam path being shown towards the bottom and the reference beam path 11 being shown left towards the reference detector array 19'. The beam splitter 7 has preferably a polarizing property. However, it is also possible to omit the beam splitter 7 in specific embodiments. In that case, there will be no reference beam path 11 either, nor the whole reference object comprising reference beam path 11, reference lens system 17', reference detector filter 23' and reference detector 19'.

In the embodiment shown with a reference object, the reference detector array 19' may be, e.g., a photodiode, a photomultiplier (photomultiplier tube, PMT), a CCD camera (Charge-Coupled Device), a CMOS (Complementary Metal Oxide Semiconductor), a diode array or an avalanche photodiode. Upstream of the reference detector array 19', the reference object may also have a reference lens system 17' for the depiction/focusing on the reference detector array 19', and/or a reference detector filter 23', such as a band pass filter, or a long pass filter or a short pass filter.

Prior to striking the sample 50, the measuring beam path 9 can be changed by additional optical means which are arranged after/downstream of the beam splitter 7. By way of example, a spot filter 21 is shown and a (first) optical correcting element 35, so as to compensate/correct, for example, the phase shift, the change in polarization and/or the beam path change, possibly generated by the second beam splitter 34 for coupling in the infrared laser radiation. In addition, a second optical correcting element 36 is shown, which may optionally be supplemented with a lens or a lens/lens system, for compensating/correcting, for example, the phase shift, the change in polarisation and/or the beam path change, which may be associated with the (second) beam splitter 34 for coupling in the infrared laser radiation. The second optical correcting element 36 and/or the optional lens or the optional lens system may also be used for focusing the beam paths on the sample 50.

The sample 50 can be provided on a carrier 46 in the form of a drop or in a sample chamber 45, as shown in FIGS. 2 to 4. In particular, the sample chamber may be a capillary, a microcavity, a reaction vessel ("Eppi"), a microfluidic system, or a pipette tip, without being limited thereto. The sample 50 to be analyzed is preferably a liquid, preferably an aqueous solution, with particles 105 present therein (see FIG. 4) which may be in dissolved or undissolved form.

The carrier 46 is preferably at least partly transparent. The shown carrier 46 is an object carrier glass, formed from glass, on which a thin film 103 is formed. The thin film 103 to be analyzed comprises, for example, a layer of functionally immobilized molecules.

The thin film 103 is affected by the sample 50 to be analyzed. For example, an interaction of the molecules on the thin film 103 with the corresponding particles 105 in the sample leads to a change in film thickness (see FIG. 4). This change in film thickness also affects the light passed via the measuring beam path 9 to the carrier 46 and reflected at the surface of the thin film, which light is diverted by the beam splitter 7 and depicted on a detector array 19. The measuring branch (right of the beam splitter 7) is preferably designed similar to the detector array 19 or even identical to the reference branch (right of the beam splitter 7). In the shown embodiment, the detector array 19 may be, for example, a photodiode, a photomultiplier (photomultiplier tube, PMT), a CCD camera (Charge-Coupled Device), a CMOS (Complementary Metal Oxide Semiconductor), a diode array or an avalanche photodiode. In front of/upstream of the detector array 19, the measuring branch may comprise a lens system 17 for depiction/focusing on the detector array 19 and/or a detector filter 23, such as a band pass filter, or a long pass filter or a short pass filter.

As already described with reference to FIG. 4, preferably multiple reflections at the boundary surfaces of the thin film are used for measurement, with the reflected beams being detected with the two detector arrays 19, 19'. The two detector arrays 19, 19' are connected with an evaluation unit which is not further described herein.

Figure 6:
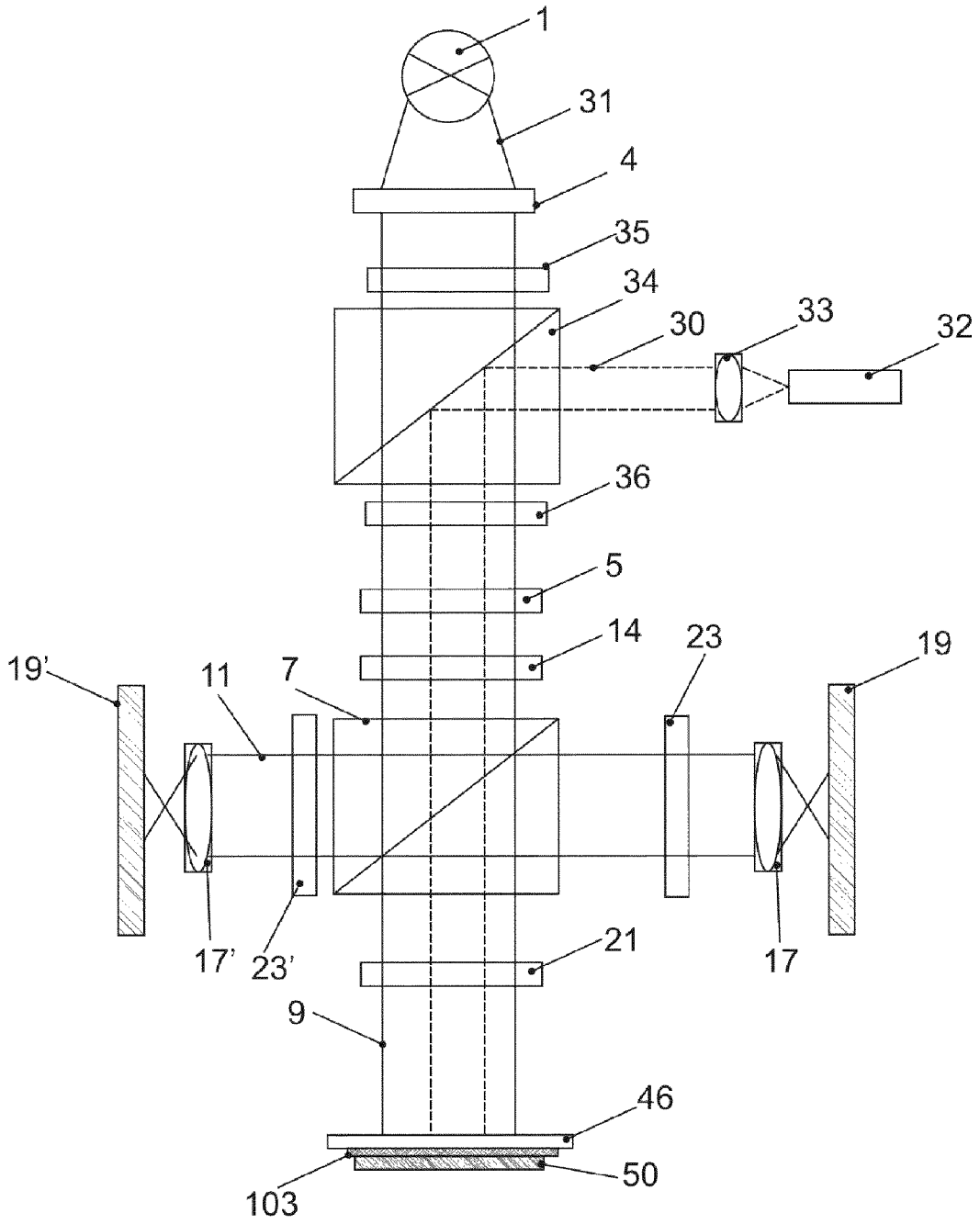
FIG. 6 shows a schematic representation similar to FIG. 5, but with a means for coupling a laser beam for generating convection in the measuring cell, which is arranged further above.

To ensure good mixing in the thin film 103 and to avoid a depletion layer, according to the invention light of a laser 32 is irradiated into the sample 50. For irradiation of the laser light, in FIG. 5, the second beam splitter 34 already mentioned above is arranged below the first beam splitter 7. In a further embodiment of the invention according to FIG. 6, in which identical reference signs refer to identical components, the second beam splitter 34 is shown, by way of example, above the first beam splitter 7. By means of the second beam splitter 34, the infrared laser radiation 30, which is emitted by the laser 32 and optionally changed by optical means 33, e.g. by lenses or a lens system, such as a collimator for parallelizing and/or focusing the infraread laser radiation, is coupled into the measuring beam path 9. The beam splitter 34 may be similar or identical to the beam splitter 7, or have other properties. For example, the beam splitter 34 may be a dichroic reflector or a "hot mirror". Here, it is again emphasized that the irradiated electromagnetic radiation 31 is used for measuring, whereas the irradiated electromagnetic radiation 30 is used for generating convection.

Here again it is explicitly emphasized that the above described test arrangement is only one of many examples of the invention and that the invention is by no means limited to a specific arrangement of the above-described optical means. In particular, the test arrangement is not limited to the shown orientation. Thus, instead from above, the light may also come from the bottom left or from the right, and the corresponding optical means can be shifted or rotated accordingly. Furthermore, the order of the optical means is not limited to the embodiment shown and can be changed depending on the desired properties for irradiation and measurement. According to the invention, a transmission may be measured instead of the reflection shown. However, a person skilled in the art will readily see that the method of the invention for generating convections can easily be implemented also in such a transmission test arrangement. In this connection, too, reference is made to FIG. 6, which shows a test arrangement very similar to the one of FIG. 5, where the light of the IR laser irradiates at another site.

Figure 1:
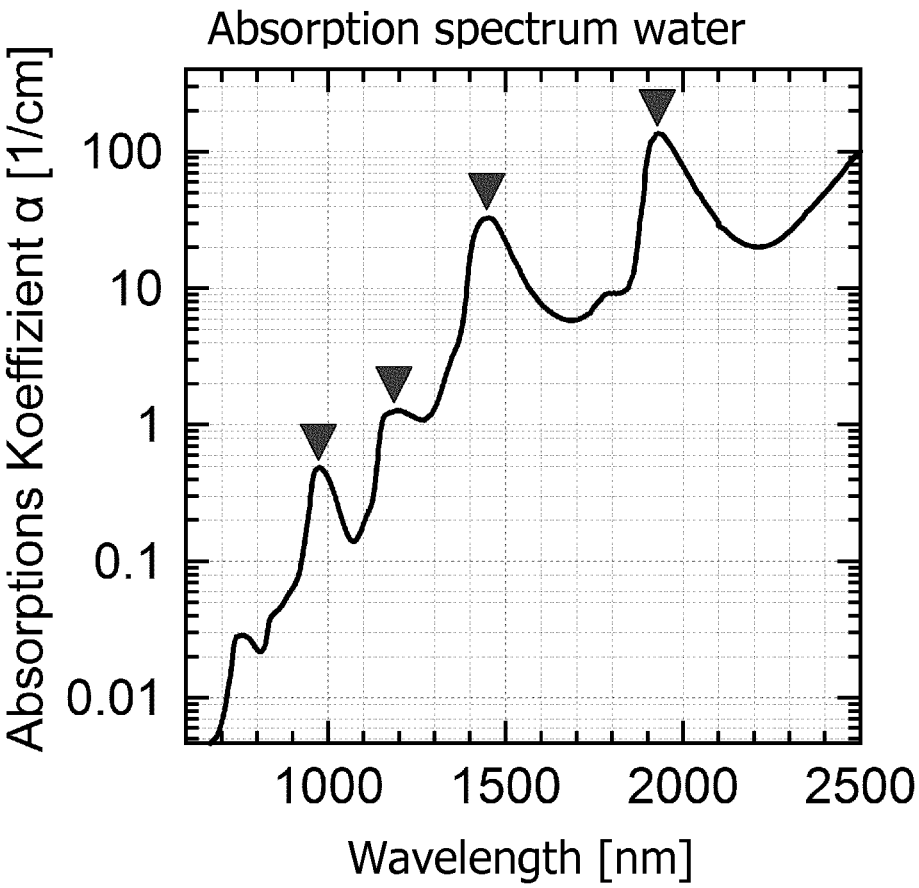
Figure 2A:
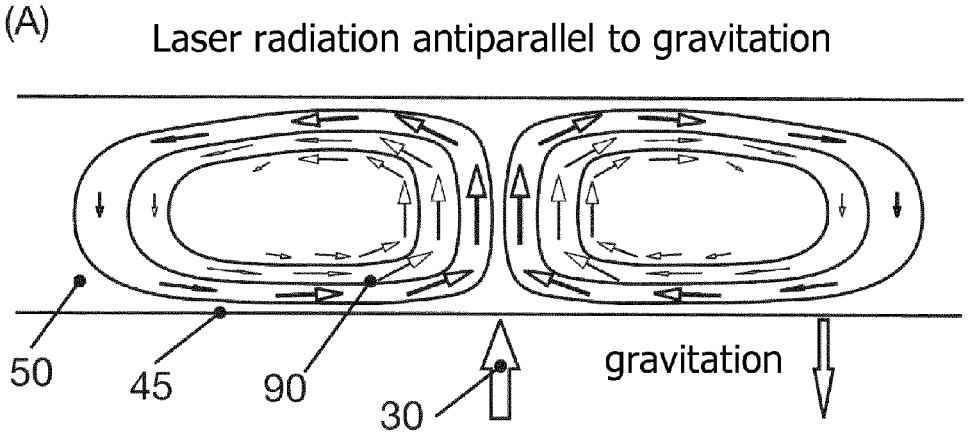
Figure 2B:
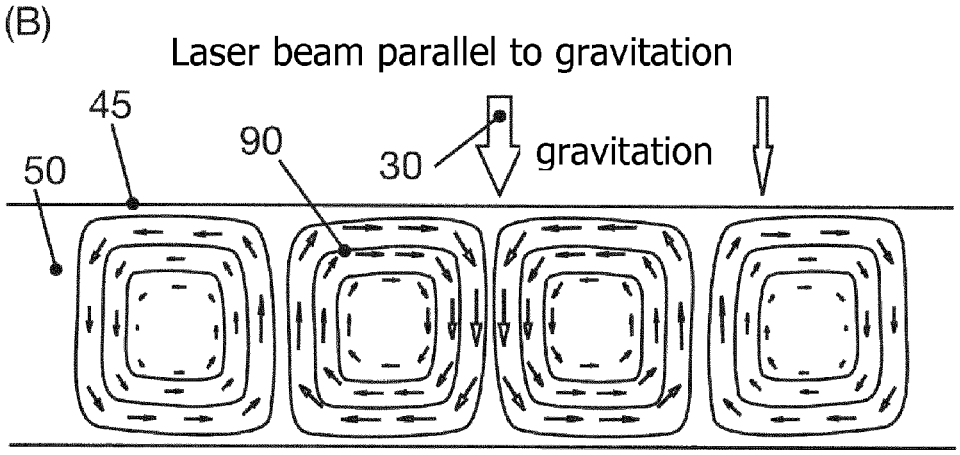

FIGS. 2A and 2B show, by way of example, the influence of the orientation of an irradiated IR laser beam 30 relative to gravitation on the thermal convection within a sample chamber 45 containing an aqueous solution 50 with particles dissolved therein (not shown). Drawn are also the velocity vectors (arrows) and the flow lines (lines) of the thermal convection 90.

When the laser radiation, as shown in FIG. 2A, is oriented antiparallel to gravitation, the radiation pressure/light pressure increases the thermal convection, i.e. the flow rate is higher than when the laser radiation is directed parallel or vertical to gravitation.

When the laser radiation is directed parallel to gravitation, as shown in FIG. 2B, the radiation pressure/light pressure mitigates the thermal convection; the flow rate is lower than when the laser radiation is directed antiparallel or vertical to gravitation.

By way of example, FIGS. 7A and 7B show the irradiation of radiation, preferably of IR radiation, e.g. of laser radiation 30 into the "well" 45 of a multi-well plate, e.g. a 96-, 384- or 1536-multi-well plate, that is filled with an aqueous solution 50. The irradiated IR radiation 30 generates a thermal convection 90 in the irradiated sample chamber "well" 45. In FIG. 7A, the IR radiation 30 is irradiated through a transparent floor 47 of a multi-well plate.

In FIG. 7B, the IR radiation 30 is irradiated through the floor but directly into the aqueous solution 50 in the sample chamber "well" 45, here from above. For example, this multi-well plate may have a non-transparent floor 48, but it may, e.g., also have a transparent floor or a partly transparent floor.

FIG. 8 shows, by way of example, the application of the method of the invention in a concrete test arrangement, without, however, being restricted thereto. Again, identical reference numerals refer to identical or similar parts. Reference numeral 1*a* designates a light source which is used for measurement. For example, light source 1*a* may be one or more LED(s), one or more laser(s) and/or one or more SLED(s) (superluminescent LED). Reference numeral 1*b* designates a light source used for measurement. For example, light source 1*b* may be one or more LED(s), one or more laser(s) and/or one or more SLED(s) (superluminescent LED). Light source 1*b* preferable has a wave length or a wave length range differing from that of light source 1*a*. The light of light source 1*a* and/or 1*b* is preferably used for irradiating a sample 50 to be analyzed. The light emitted from light sources 1*a* and/or 1*b* can be modified by known optical means, e.g. by a lens 26 and/or by a lens system (not shown) or an aperture (not shown) or a polarization filter. Subsequently, the light from the light source 1*a* preferably passes an excitation filter 25, preferably a band pass filter, and the light from the light source 1*b* preferably passes an excitation filter 24, preferably a band pass filter. The excitation filter 24 preferably has another transmission range than the excitation filter 25. Reference numeral 23 refers to an optional detector filter, such as a band pass filter or a long pass filter or a short pass filter or a dual pass filter or a multi pass filter. In the case of fluorescence, the filter 23 may also be designated as an emission filter.

The light from the two excitation light sources is preferably combined, for example by means of the dichroic mirror 28 and is subsequently preferably reflected by a further dichroic mirror 29 into the direction of the lens system 38. The dichroic mirror 29 is preferably also used for separating the excitation light from the detection light. After reflection at the dichroic mirror 29, the excitation light preferably passes a further dichroic mirror 34 ("Hot Mirror") and is preferably subsequently focussed by the lens system 38 through the transparent floor 47 of the multi-well plate into the aqueous solution 50, in the sample chamber 45, which is preferably a "well" of a multi-well plate. There the excitation light activates the fluorescence of fluorescent particles 105, such as proteins with intrinsic fluorescence and/or fluorescently labelled biomolecules or other fluorescent substances. The fluorescent light is collected by the lens system 38, preferably a lens, a combination of lenses or a microscope objective; it subsequently passes the dichroic mirrors 34 and 29, then the detection filter 23, which is preferably an emission filter, such as a band pass filter, dual pass filter or multi-pass filter, and is then focussed by a lens 17, for example, an asphere, onto the detector 19, such as a photodiode, a PMT, a CCD camera, a CMOS camera, a diode array, an avalanche photodiode.

With this detector it is possible to measure, and then to electronically process and save the intensity and/or phase and/or the temporal sequence of the fluorescence intensity. The infrared radiation for generating thermal convection is preferably produced with a fiber-coupled infrared laser 32. The fiber of the laser is coupled, for example, by means of a fiber coupling 27, into the optics or the optic system. The infrared radiation can be modified by means of known optical means, for example, by means of a lens 26 and/or of a lens system (not shown) or by means of an aperture (not shown) or a polarization filter. For example, it can be parallelized or focussed by the lens 26, such as an asphere. Subsequently, the infrared radiation is reflected through the dichroic mirror 34 ("Hot Mirror") into the lens system 38. The lens system 38 then focusses the infrared radiation 30 through the transparent floor 47 of the multi-well plate into the aqueous solution 50 of the sample chamber 45, preferably a "well" of a multi-well plate. The multi-well plate is preferably a 96-well plate or a 384-well plate or a 1536-well plate. Depending on actual focus, the infrared radiation 30 generates therein a defined thermal convection 90 for mixing the particles 105 in the aqueous solution 50.

The particles are, for example, biomolecules such as DNA, RNA, PNA, proteins, antibodies, antigens, or small molecules, cells, viruses, bacteria, microbeads, nanobeads, nanoparticles, polymers, peptides. The apparatus may also be used, for example, for detecting and quantifying biomolecule aggregation, e.g. the aggregation of proteins, or therapeutic antibodies.

The invention claimed is:

1. Method for mixing liquids (50) or particles with a liquid (50), comprising the steps:

a. providing a volume of liquid (50);

b. generating a thermal convection flow at least one surface/boundary surface of the volume of liquid by irradiating infrared radiation up to 2000 nm (30) into the volume of liquid such that a depletion or concentration layer at said surface/boundary surface is avoided.

2. Method according to claim 1, wherein the volume of liquid (50)

i) is provided in a sample chamber (45) having an inner diameter of from 0.05 mm to 0.8 mm, or ii) is provided as drop(s) on an object carrier.

3. Method according to claim 2, wherein the volume of liquid (50) is provided in a sample chamber (45) having an inner diameter of from 0.05 mm to 0.8 mm, and, wherein the surface of the volume of liquid is the boundary layer between the volume of liquid and a surface of the sample chamber.

4. Method according to claim 2, wherein the volume of liquid (50) is provided as drop(s) on an object carrier, wherein the surface of the volume of liquid is the boundary layer between the volume of liquid and a surface of the object carrier.

5. Method according to claim 1, wherein the liquid (50) is an aqueous solution.

6. Method according to claim 1, wherein the radiation (30) is directed parallel and/or antiparallel to gravitation and/or comprises a component that is oriented vertical to gravitation.

7. Method according to claim 1, wherein a temperature gradient of from 0.001 K/μm to 2 K/μm is generated with the irradiated radiation (30).

8. Method according to claim 7, wherein the generated temperature gradient is generated in an area of from 0.0001 $mm^2$ to 12 $mm^2$.

9. Method according to claim 8, wherein a detection region (80) for measuring properties of the liquid or of the particles in the liquid is spaced apart from the irradiation area of radiation (30).

10. Method according to claim 1, wherein flow rates of from 0.0005 mm/s to 2 mm/s are generated within the convection flow.

11. Method according to claim 1, wherein a sample chamber (45) is present in the form of a capillary or multi-well plate or microfluidic chip.

12. The method according to claim 1, wherein the infrared radiation is focused in the volume of liquid.

13. The method of claim 2, wherein the volume of liquid (50) is provided in a microcavity.

14. The method of claim 2, wherein the volume of liquid (50) is provided in a capillary.

15. The method of claim 14, wherein the capillary is made from glass.

16. The method of claim 1, wherein the radiation is produced by an LED or laser.

17. Method according to claim 9, wherein the detection region (80) for measuring properties of the liquid or of the particles in the liquid is spaced apart from the irradiation area of radiation (30) by at least 0.01 mm.

18. Method for analyzing molecular interactions of particles at and/or in a thin film in a volume of liquid, comprising the step of:

providing, on an object carrier or a sample chamber (45), at least one volume of liquid (50) with particles present therein, and irradiating infrared radiation up to 2000 nm into the volume of liquid (50) for generating the thermal convection flow, measuring the interaction of the particles with a surface/boundary surface of a sample chamber or an object carrier, characterizing the interaction of the particles on the basis of the measurement.

19. Method according to claim 18, wherein the interaction is measured by reflectometric interference spectroscopy (RIfs).

20. Method according to claim 18, wherein the interaction is measured by surface plasmone resonance (SPR).

21. Method according to claim 18, wherein the interaction is measured by enzyme linked immunosorbent assay (ELISA).

22. Method according to claim 18, wherein the interaction is measured by a quartz crystal microbalance (QCM).

23. Method according to claim 18, wherein the interaction is measured by a surface acoustic wave (SAW).

24. Method according to claim 18, wherein the interaction is measured by at least one method from the group of: reflectrometric interference spectroscopy (RIfs), bio-layer interferometry (BLI), surface plasmone resonance (SPR), quartz crystal microbalance (QCM), surface acoustic wave (SAW), enzyme linked immunosorbent assay (ELISA), nanopores or transistors (next generation sequencing).

* * * * *